US006792664B2

(12) United States Patent
Herrmannsen et al.

(10) Patent No.: US 6,792,664 B2
(45) Date of Patent: Sep. 21, 2004

(54) DEVICE FOR TRANSFERRING A MATERIAL IN THE FORM OF A FILM APPLIED TO A CARRIER STRIP ONTO A SUBSTRATE

(75) Inventors: Wulf Herrmannsen, Ronnenberg (DE); Wolfgang Bauersachs, Wedemark (DE); Christoph Manusch, Hemmingen (DE); Hartmut Rudolf, Hannover (DE)

(73) Assignee: Pritt Produktionsgesellschaft mbH, Hanover (DE)

( * ) Notice: Subject to any disclaimer, the term of this patent is extended or adjusted under 35 U.S.C. 154(b) by 0 days.

(21) Appl. No.: 10/295,312

(22) Filed: Nov. 15, 2002

(65) Prior Publication Data

US 2003/0066612 A1 Apr. 10, 2003

Related U.S. Application Data

(62) Division of application No. 09/763,427, filed as application No. PCT/EP99/05787 on Mar. 2, 2000, now Pat. No. 6,481, 485.

(30) Foreign Application Priority Data

Aug. 19, 1998 (DE) ..... 198 37 573
Dec. 22, 1998 (DE) ..... 198 59 269

(51) Int. Cl.[7] ..... B23P 19/00

(52) U.S. Cl. ..... 29/450; 29/789; 29/797; 83/870

(58) Field of Search ..... 83/870, 872, 873, 83/54, 178, 180, 184, 188, 189, 191, 192, 195; 29/450, 789, 797, 430, 235

(56) References Cited

U.S. PATENT DOCUMENTS 3,715,941 A * 2/1973 Andrews et al. ..... 83/180
3,921,482 A * 11/1975 Osborn ..... 83/54
4,160,398 A * 7/1979 Bichot et al. ..... 83/54
4,957,022 A * 9/1990 Harris ..... 83/54

* cited by examiner

*Primary Examiner*—Stephen Choi

(57) ABSTRACT

A device for transferring a film from a carrier strip onto a substrate such as a sheet of writing or drawing paper comprises a housing in which a supply reel and an empty reel are arranged. The film-coated carrier strip is guided over an applicator foot which is looped around by the carrier strip with a clip-type slide element of a friction-reducing material secured to the applicator foot. The applicator foot comprises a pivotally hinged extension arm having an end in the end portion for receiving a profile member for the slide element.

8 Claims, 8 Drawing Sheets

Figure 1:
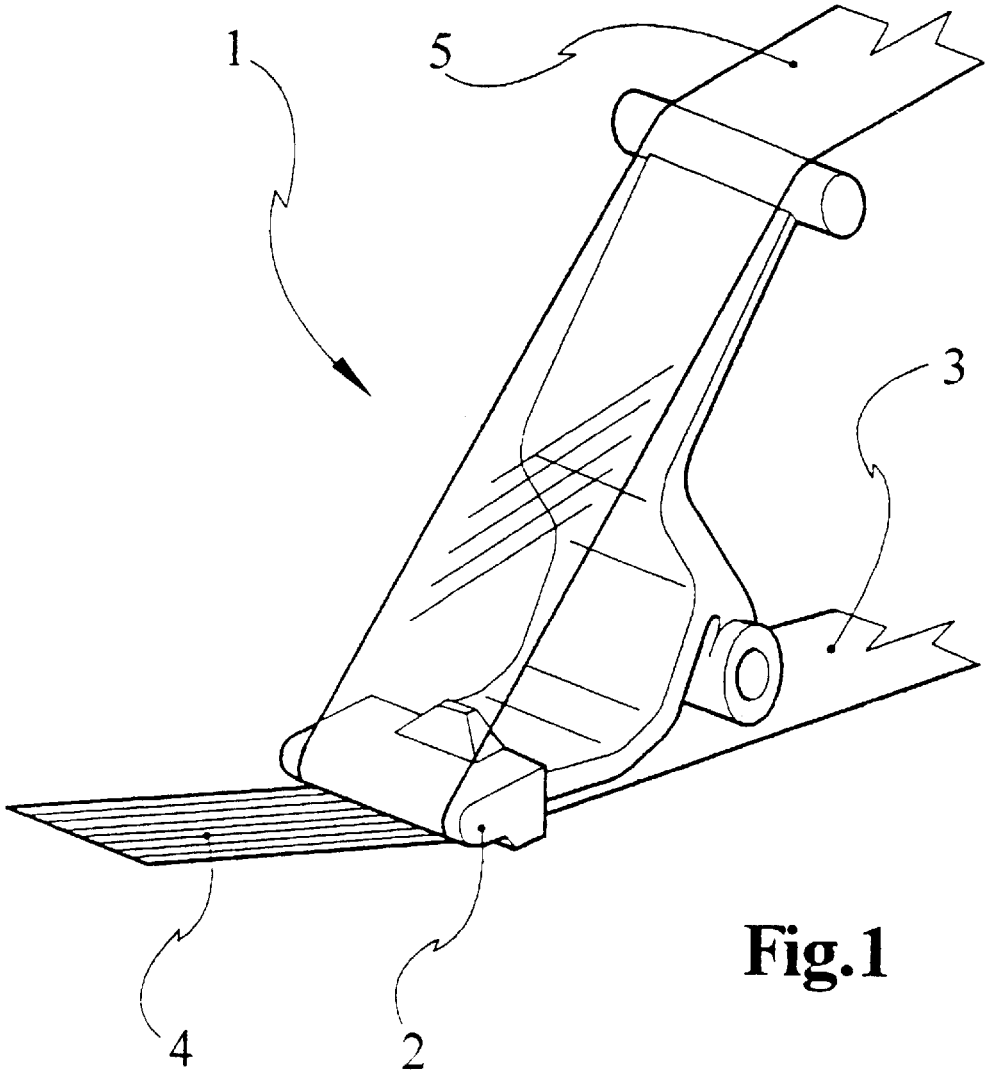

DEVICE FOR TRANSFERRING A MATERIAL IN THE FORM OF A FILM APPLIED TO A CARRIER STRIP ONTO A SUBSTRATE

CROSS REFERENCE TO RELATED APPLICATION

This application is a division of application Ser. No. 09/763,427, filed Feb. 20, 2001, now U.S. Pat No. 6,481,485 which is a 371 of PCT/EP99/05787 filed on Mar. 2, 2000.

BACKGROUND OF INVENTION

The invention relates to a device for transferring a material in the form of a film applied to a carrier strip onto a substrate, such as a sheet of writing or drawing paper, comprising a housing in which a supply reel for the film-coated carrier strip and an empty reel for receiving the de-coated carrier strip are arranged, wherein the film-coated carrier strip is guided over an applicator foot provided at least in the region which is looped around by the carrier strip with a clip-type slide element of a friction-reducing material secured to the applicator foot.

Hand devices of that kind for transferring a film (for example, adhesive strip, concealing substance, marking ink, etc.) are known. In that case, in order to achieve a smooth motion and good capability of transfer of the film onto the substrate various embodiments for the shapes of the applicator foot are known. Thus, the applicator foot can be equipped with, for example, an applicator roller which preferably has a rubber-elastic running surface. However, as the external diameter of a functionally effective applicator roller cannot be kept as small as desired, because a good adaptation to the substrate requires a minimum thickness for the elastic running ring and the rotational mobility presupposes a sufficient difference between axle stub and external diameter, such an applicator roller has disadvantages. Accordingly, in most solutions the applicator foot usually has an applicator strip which has advantages relative to an applicator roller, as a sharper angling of the carrier strip is possible in the transfer phase, whereby the torn-off piece has less tendency to formation of a wavy edge after completion of the transfer. Thereagainst it is disadvantageous relative to the applicator roller solution that in the case of the applicator strip the carrier strip is guided thereover with a friction couple which, in dependence on the respective carrier strip quality, can lead to undesired heavygoing.

In principle, synthetic materials which have a good sliding property are known, for example polytetrafluorethylenes (PTFE), but which are higher in cost by a multiple than the standard materials usually used for the components of a device of the kind in question.

Accordingly, the use of an applicator foot of polytetrafluorethylene is excluded on cost grounds.

As polytetrafluorethylene is not a true thermoplastic, a loading of the region, which is effective with respect to guidance, of the applicator foot by this high-quality material in a multi-component injection-moulding process or a subsequent injection-moulding process has to be excluded. A conceivable solution, such as gluing the applicator strip by a self-adhesive foil coated with fluoro synthetic material, has in fact been attempted already, but from the viewpoint of production engineering is unsuitable for mass-produced articles.

A device of the category in question is known from U.S. Pat. No. 5,430,904. In this device the applicator foot is provided in the region which is looped around by the carrier strip with a slide element made of a friction-reducing, rubber-elastic material and fastened to the applicator foot. This slide element is to serve the purpose of achieving faultless transfer of the film onto the substrate. However, it has proved that the smooth motion of the device and the transfer of the film to the substrate is still capable of improvement.

SUMMARY OF THE INVENTION

It is accordingly the object of the invention to so improve a device according to the category that the smooth motion of the device and faultless transfer of the film onto the substrate are guaranteed in return for smallest possible use of material and with particular consideration of economic capability of manufacture and possibility of assembly.

In accordance with the invention this object is met in the case of a device of the kind denoted in the introduction in that the applicator foot comprises a pivotably hinged extension arm having at the end a receiving profile member (end portion) for the slide element.

On the one hand, due to this construction there is achieved, within certain limits, a more flexible articulation of the applicator strip with the slide element at the applicator foot, whereby a better transfer of the film is achieved even to a not completely flat substrate. On the other hand, the clip-type slide element can be mechanically pushed in simple manner onto the extension arm in the pivoted-out position thereof after a spreading process and can be securely fastened to the applicator foot by pivoting in and locking of the arm.

The slide element itself can be produced from, for example, a polytetrafluorethylene tube as a semi-finished product of the smallest dimensions (for example, with an external diameter of 1 to 1.2 millimetres and 0.2 to 0.3 millimetres wall thickness), in that it is cut off to the desired length, slit in longitudinal direction and then spread apart and pushed onto the applicator foot. This can be carried out automatically in simple manner.

In an advantageous embodiment it is provided that the extension arm is securable to the applicator foot in the pivoted-in position by means of a detent connection. After the automatic pushing on of the clip-type slide element the extension arm can then be mechanically pivoted in and then automatically locked to the applicator foot in the pivoted-in position. Moreover, it is, with advantage, provided that abutment steps for securing against twisting and recesses for securing against longitudinal displacement of the clip-type slide element are provided at the applicator foot and/or extension arm.

In order to further facilitate handling of the device it is proposed that the extension arm is provided with longitudinally oriented ribs. These ribs serve, preferably in conjunction with selection of an elastic material—for example, a polyolefin—for the extension arm, for ensuring contact between the applicator foot and possible unevennesses of the substrate plane. As the slide element is similarly elastic, it is thus achieved that even in the case of a non-planar substrate the entire transfer width is acted on by pressure and, in similar manner to an elastic roller, formation of bubbles is prevented.

With particular advantage it is proposed in that case that the ribs rise in wedge-shaped manner starting from the slide element and each have a rear wall which in the pivoted-in position of the extension arm bears against a respective abutment of a cross-member of the applicator foot. In this manner it is possible to bias the ribs in a specific way in the pivoted-in position of the extension arm so as to ensure a bubble-free transfer of the film to the substrate in the case of a non-planar substrate.

In that case it is proposed with particular advantage that the prism-shaped abutments are so constructed that they together form an approximately arcuate support profile for the rear walls of the wedge-shaped ribs. It is thus achieved that the ribs are biased to increasingly greater extent towards the middle of the extension arm and in consequence thereof the slide element describes a spherical course relative to the substrate plane, so that even in the case of a non-planar substrate a sufficient application pressure for a bubble-free transfer is achieved over the entire transfer width.

In order to be able to carry out production of the device in particularly simple manner, i.e. automatically, there is also proposed in accordance with the invention a method for production of the device in which a supply reel with a film-coated carrier strip and an empty reel are inserted into the housing of the device, wherein the method is distinguished by the fact that for formation of the clip-type slide element a tube section of friction-reducing material is located and held, is slit in longitudinal direction and is pushed, while being spread apart, onto the applicator foot or the extension arm.

In that case, for example, a polytetrafluorethylene tube can be fed as a semi-finished product of smallest dimensions, for example with an external diameter of 1 to 1.2 millimetres and a wall thickness of 0.2 to 0.3 millimetres, to an automatic machine, cut to length there, slit mechanically or by another cutting technique, such as laser or water jet cutting, in longitudinal direction and subsequently spread apart by means of a conical holding mandrel to the required assembly profile, whereupon the clip-type slide element is then laterally stripped off onto the applicator foot or the extension arm of the applicator foot.

For carrying out this above-described process there is provided a device which is distinguished by a gripper-like holding device for the tube section, a conical retaining mandrel and a cutting device.

THE DRAWINGS

Figure 2:
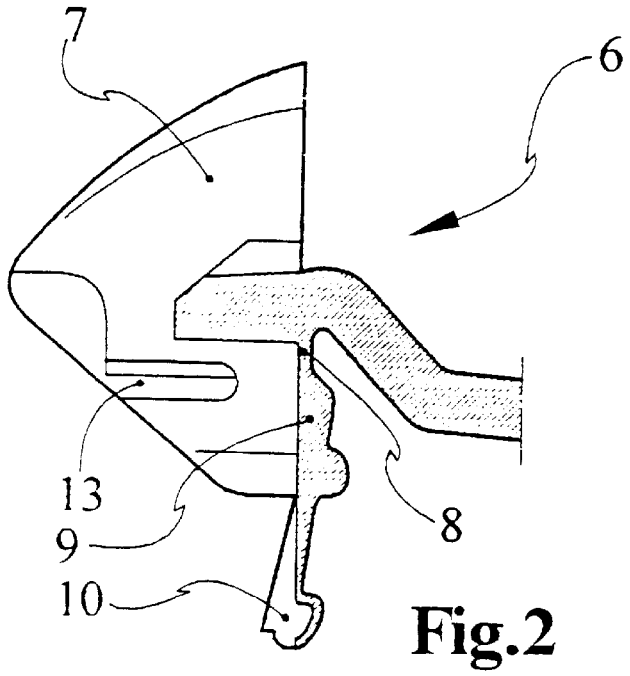
Figure 2A:
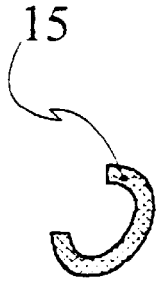
Figure 3:
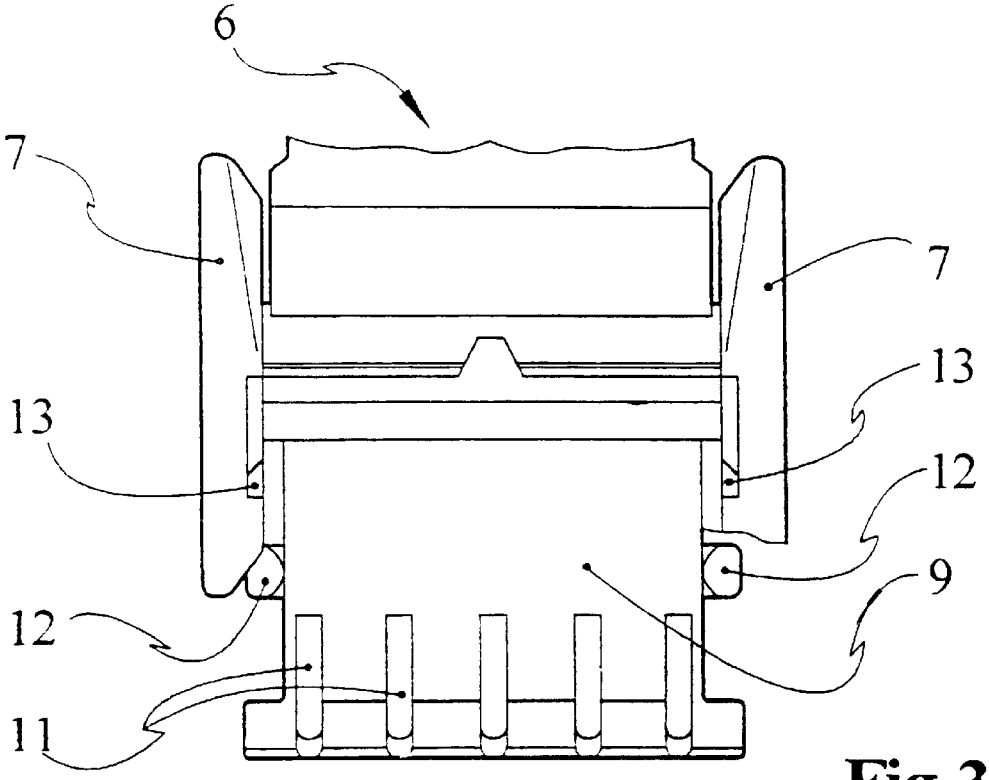
Figure 4:
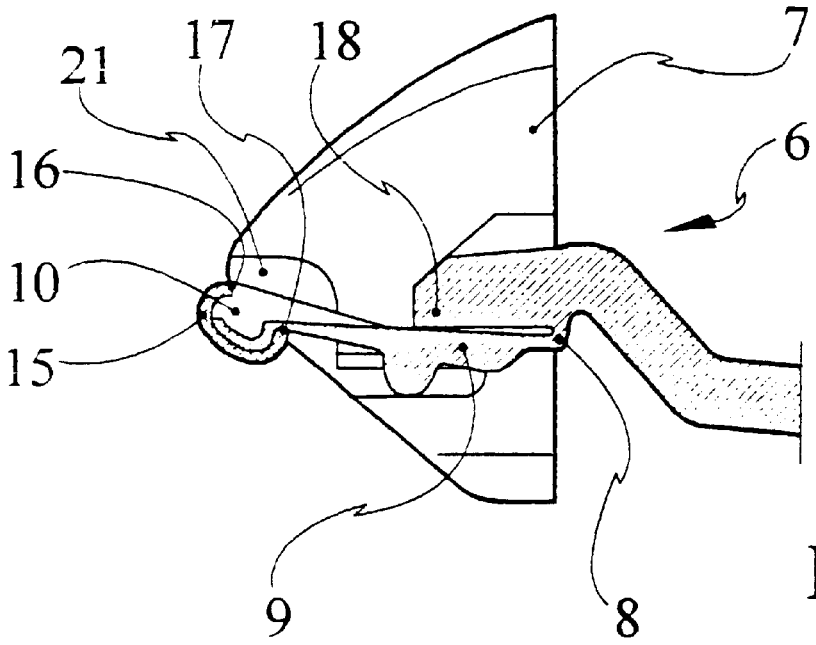
Figure 5:
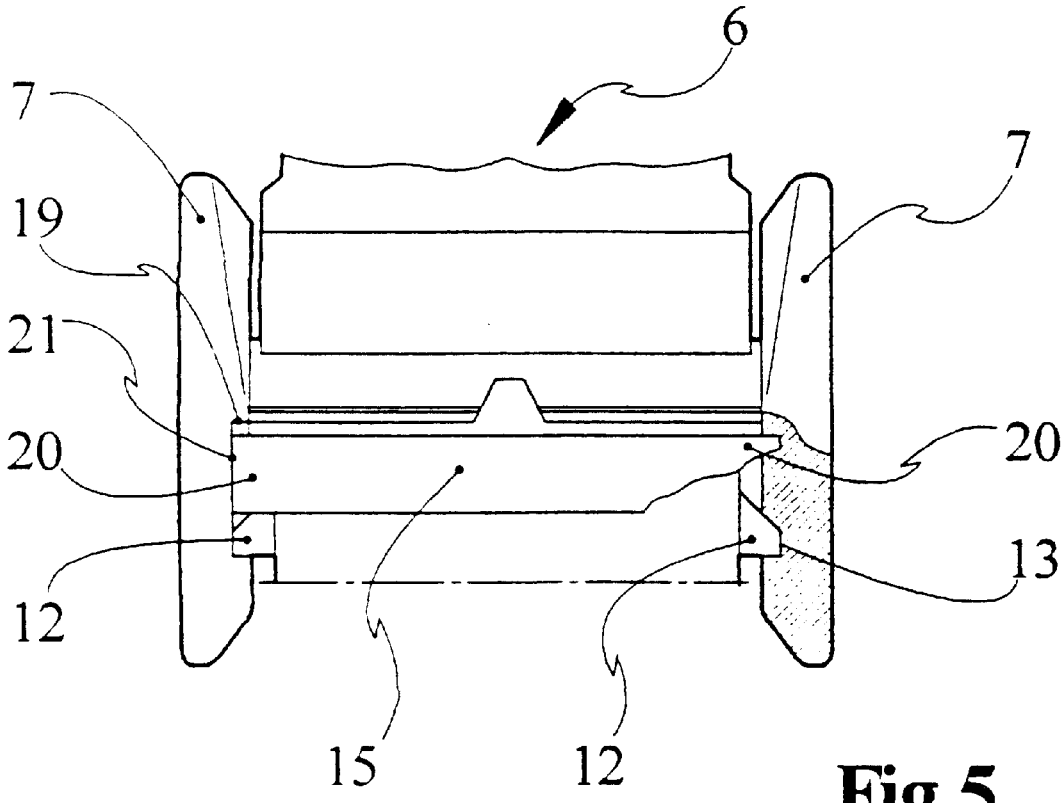
Figure 6:
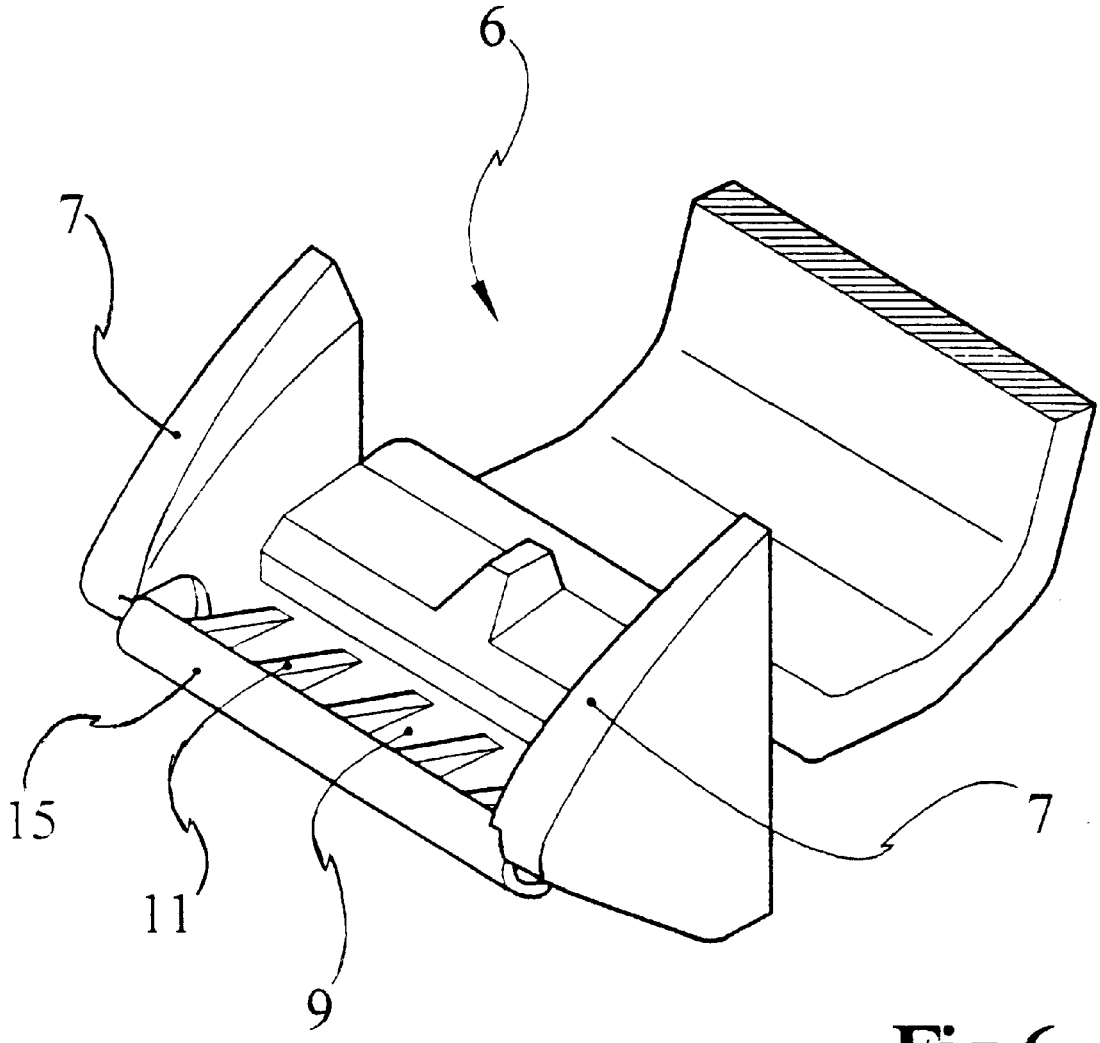
Figure 6A:
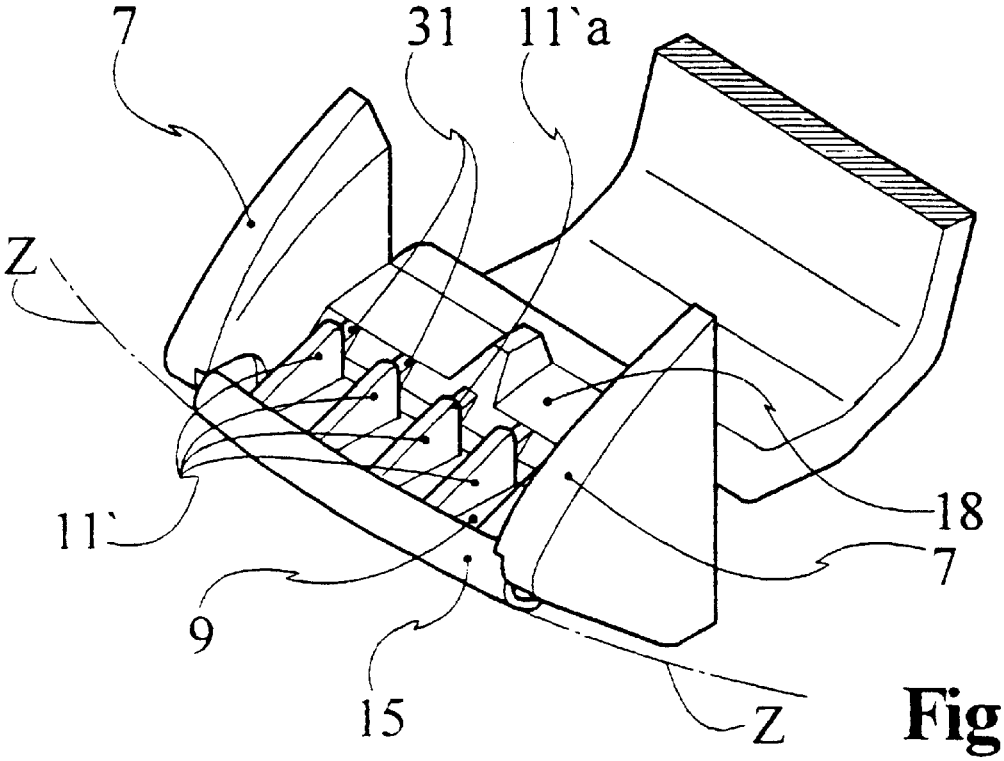
Figure 6B:
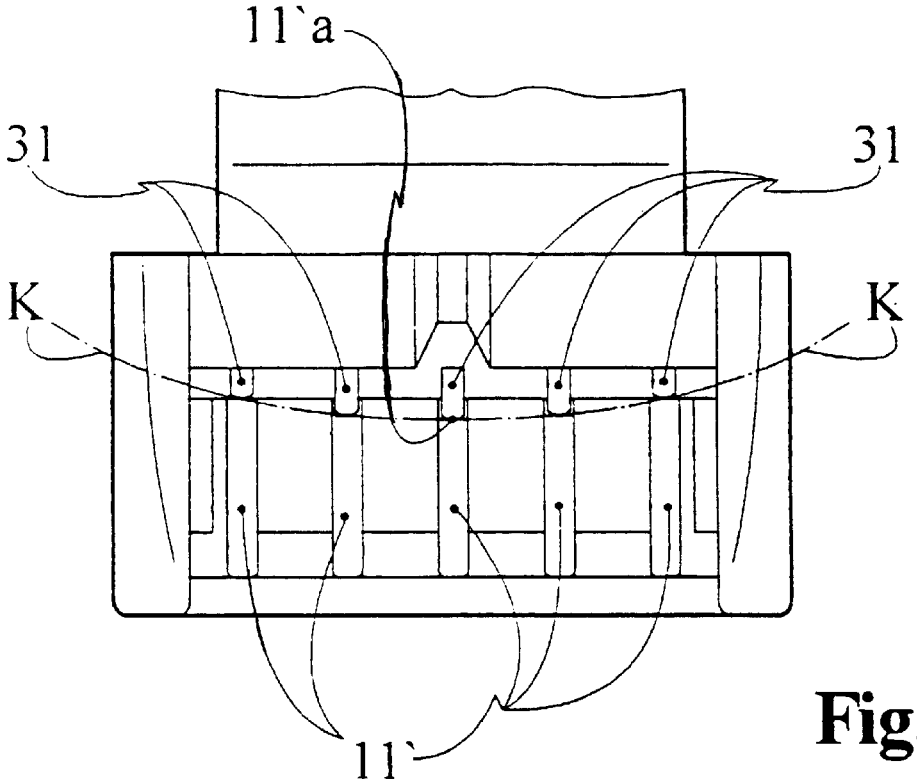
Figures 7A, 7B, 7C, 7D:
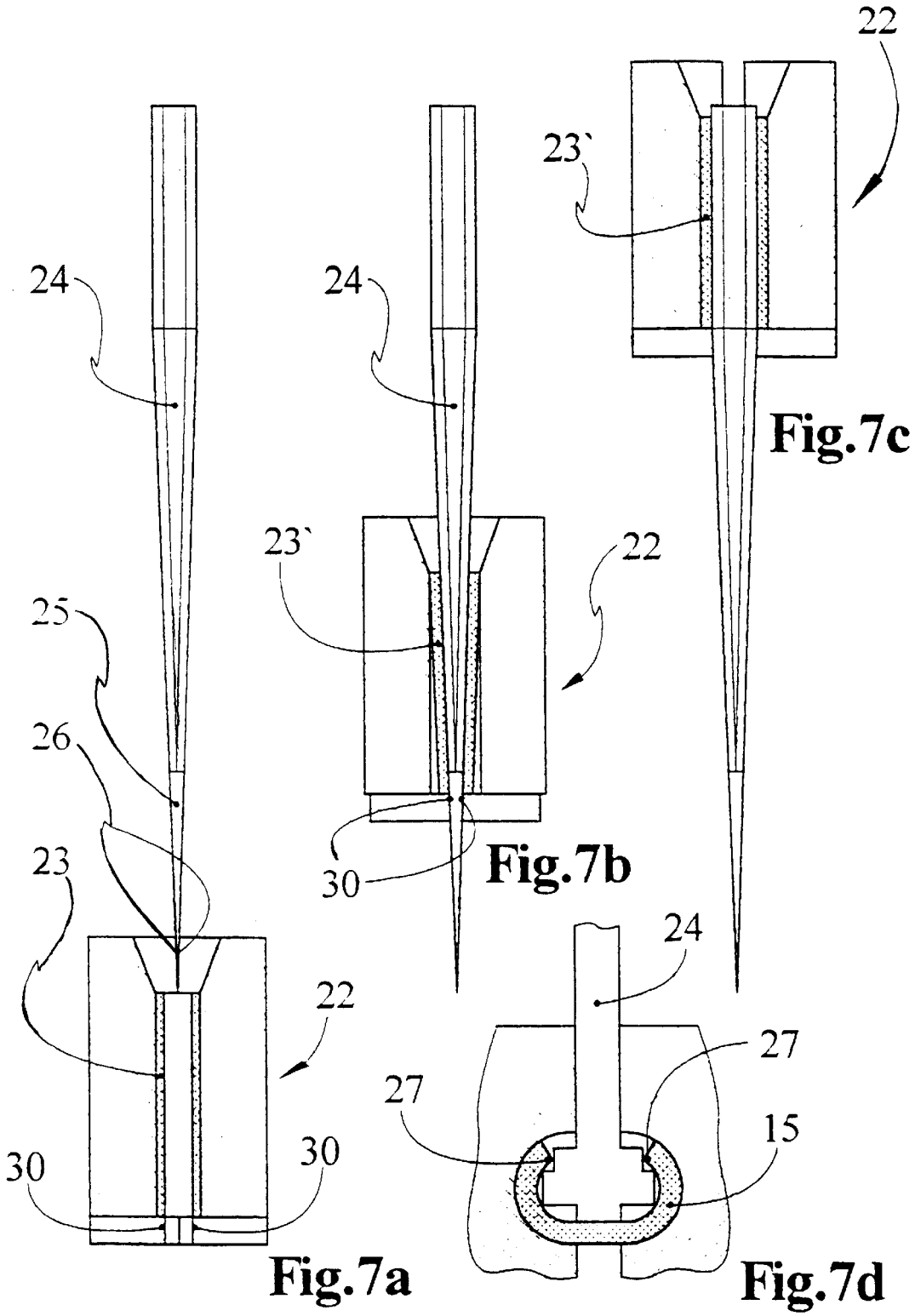
Figure 8:
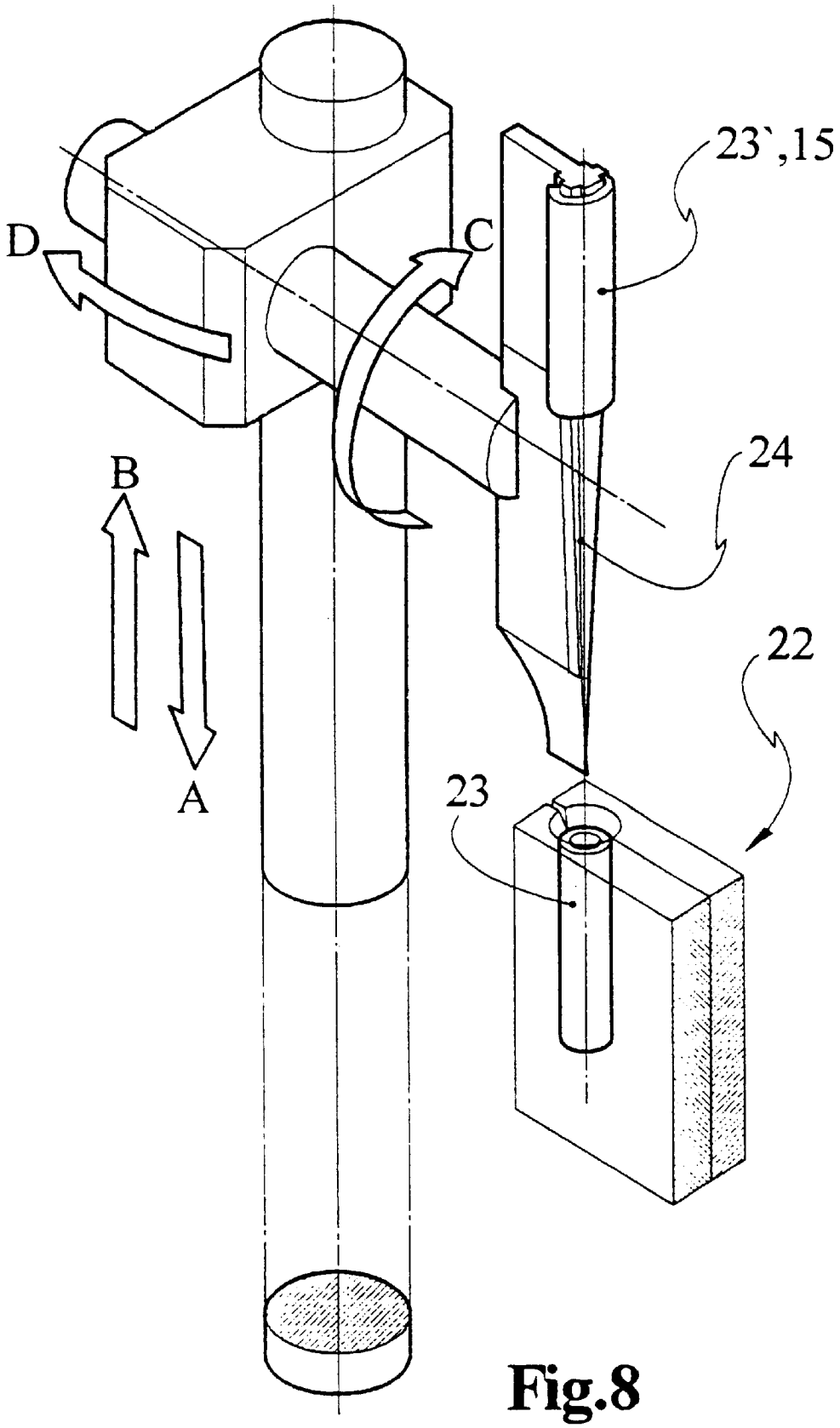

The invention is hereinafter described in more detail by way of example with reference to the drawing, in which:

FIG. 1 is a perspective illustration of an applicator foot of a device according to the state of the art, FIG. 2 is a side view partly in section of the applicator foot of a device according to the invention, without slide element, FIG. 2*a* is a section of the slide element for the device according to FIG. 2, FIG. 3 is the front view of the applicator foot, FIG. 4 is a side view partly in section of the applicator foot according to FIG. 2, with pivoted-in extension arm, FIG. 5 is a front view of FIG. 4, FIG. 6 is a perspective illustration of the applicator foot, FIG. 6*a* shows, in the same illustration as in FIG. 6, a particularly preferred modified form of embodiment of the applicator foot, FIG. 6*b* shows the applicator foot according to FIG. 6*a* in plan view, FIGS. 7*a* to 7*d* show, partly in section and in simplified illustration, a device for production of the device according to the invention, FIG. 8 is a perspective illustration, in simplified representation, of the device according to FIGS. 7*a* to 7*d* and FIGS. 9 and 9*a* again show the aforesaid device.

DETAILED DESCRIPTION

A device according to the category in question, and belonging to the state of the art, for transferring a material in the form of a film applied to a carrier strip onto a substrate is illustrated in FIG. 1, although only the part significant for the invention, namely an applicator foot which is denoted generally by 1. This applicator foot 1 is equipped with an applicator strip 2, around which a coated carrier strip 3, coming from a supply reel, which is not illustrated, of the device is guided. After the transfer of the coating 4 onto a substrate it is passed on as an empty strip 5 to a winding-up reel, which is not illustrated. It has emerged that such an applicator foot 1 is not satisfactory with respect to easy motion of the device and faultless transfer of the film onto the substrate.

According to the invention another design of the applicator foot is therefore provided, this being illustrated in FIG. 2 et seq.

An applicator foot according to the invention of a device in accordance with the invention is denoted generally by 6 in the figures. This applicator foot 6 comprises strip guide ears 7 between which the carrier strip is guided. The applicator foot 6 is provided with an extension arm 9 pivotably hinged to the applicator foot 6 by way of a film hinge 8. This extension arm 9 is formed at its end as a receiving profile member (end portion 10) for a clip-type slide element 15. Grooves 13 are cut out of the applicator foot 6 and serve the purpose of achieving a detent latching of the extension arm 9 to the applicator foot 6 in the pivoted-in position of the extension arm 9, for which purpose detent dogs 12 are provided on the extension arm 9 at both outer sides.

As evident from FIG. 3, the extension arm 9 comprises ribs 11 which are, for preference, longitudinally oriented. These ribs 11 serve, in conjunction with a selection of an elastic material, for example polyolefin, to ensure contact between the applicator strip (end portion 10) and possible unevennesses of the substrate plane. As the clip-type slide element 15 of polytetrafluorethylene is similarly elastic, it is thereby achieved that even in the case of a non-planar substrate the entire transfer width of the strip is subjected to pressure and, similarly to an elastic roller, formation of bubbles is reliably prevented so that a smooth coating onto the substrate takes place.

FIGS. 4 and 5 show the extension arm 9 in pivoted-in and locked position. In that case the film hinge 8 is pivoted through about 90°. The clip-type slide element 15 placed on the end portion 10 of the extension arm 9 is additionally fastened in the manner that abutment steps 16 and 17 are provided at the applicator foot 6 or extension arm 9, whereby the slide element 15 is secured against rotation. It is achieved through contact of the extension arm 9 with a cross-member 18 of the applicator foot 6 that the free end portion 10 of the extension arm 9 can flexibly spring out in its entirety.

The applicator foot 6 with detent dogs 12 notched in the grooves 13 and correspondingly fastened slide element 15 is recognisable in front view from FIG. 5. Through abutments 19 at the applicator foot 6 it is achieved that, in the case of possible excessive applied pressure by inappropriate handling of the device, the applicator strip formed by the slide element 15 reaches a final end abutment which is so dimensioned that the slide element 15 always protrudes by a few tenths of a millimetre beyond the profile of the strip guide ears 7, so that the transfer function is remains secured. Moreover, it is recognisable that the ends 20 of the clip-type slide element 15 are advantageously arranged to be recessed in recesses 21 of the strip guide ears 7, whereby it is ensured that the carrier strip is kept away from the ends 20 possibly compressed by the cutting to length of the tube from which the slide element 15 is preferably produced.

In FIG. 6 the entire applicator foot 6 is illustrated again in functional position, i.e. with pivoted-in and locked extension arm 9, and in particular in the end position of the clip-type slide element 15 with securing against rotation and longitudinal displacement.

An alternative embodiment is illustrated in FIGS. 6*a* and 6*b*, in which the ribs are differently shaped, these ribs being denoted by 11'. The ribs 11' rise in rearward direction in wedge shape starting from the slide element 15 and each have a rear wall 11'*a*, which in the pivoted-in position of the extension arm 9 bears against a respective abutment 31 at the cross-member 18 of the applicator foot 16. In that case the prismatic abutments 31 are constructed so that they together form an approximately arcuate contact profile K—K for the rear walls 11'*a* of the wedge-shaped ribs 11'.

It is achieved by this design that the ribs 11' are biased to increasingly greater extent towards the centre of the extension arm 9 and in consequence thereof the slide element 15 describes a spherical course Z—Z relative to the substrate plane and thus, even in the case of a non-planar substrate, a sufficient application pressure for a bubble-free transfer is attained over the entire transfer width.

A device for production of the clip-type slide element 15 is shown in strongly simplified representation in FIGS. 7*a* to 7*d*. This device comprises, first of all, a gripper 22 to which a polytetrafluorethylene tube section 23 is fed. This tube section in that case comes into contact with an annular step 30 of the gripper 22. A substantially conical retaining mandrel 24 with a front-mounted knife 25 is moved downwardly within the gripper 22 and starts cutting, wherein guide chamfers 26 of the gripper 22 serve as an aid at the junction (FIG. 7*a*).

On further downward movement of the retaining mandrel 24 (FIG. 7*b*), the now cut-open tube section 23' is continuously spread apart by the conicity of the retaining mandrel 24 and the gripper 22 is opened, wherein the abutments of the annular step 30 travel therewith and thus prevent the tube section 23' from giving away.

In the illustration according to FIG. 7*c* the retaining mandrel 24 has reached its end position. The tube section 23' has now received the cross-sectional profile of the end piece 10 of the extension arm 9.

As evident from FIG. 7*d*, the special profiling of the retaining mandrel 24 in its upper end region ensures that the cut edges of the clip-type slide element 15 are held exactly in position by abutment steps 27 at the upper region of the retaining mandrel 24.

The working sequence according to FIGS. 7*a* to 7*c* is reproduced again in perspective illustration in FIG. 8 by reference to a symbolically reproduced device, from the tube section 23 up to the shaping, appropriate for mounting, of the processed tube section 23' or the clip-type slide element 15 resulting therefrom.

After lowering of the retaining mandrel 24 in the arrow direction A the gripper 22 is opened and the retaining mandrel moved back in direction B, rotated through 180° in the arrow direction C and pivoted in the arrow direction D.

Figures 9, 9A:
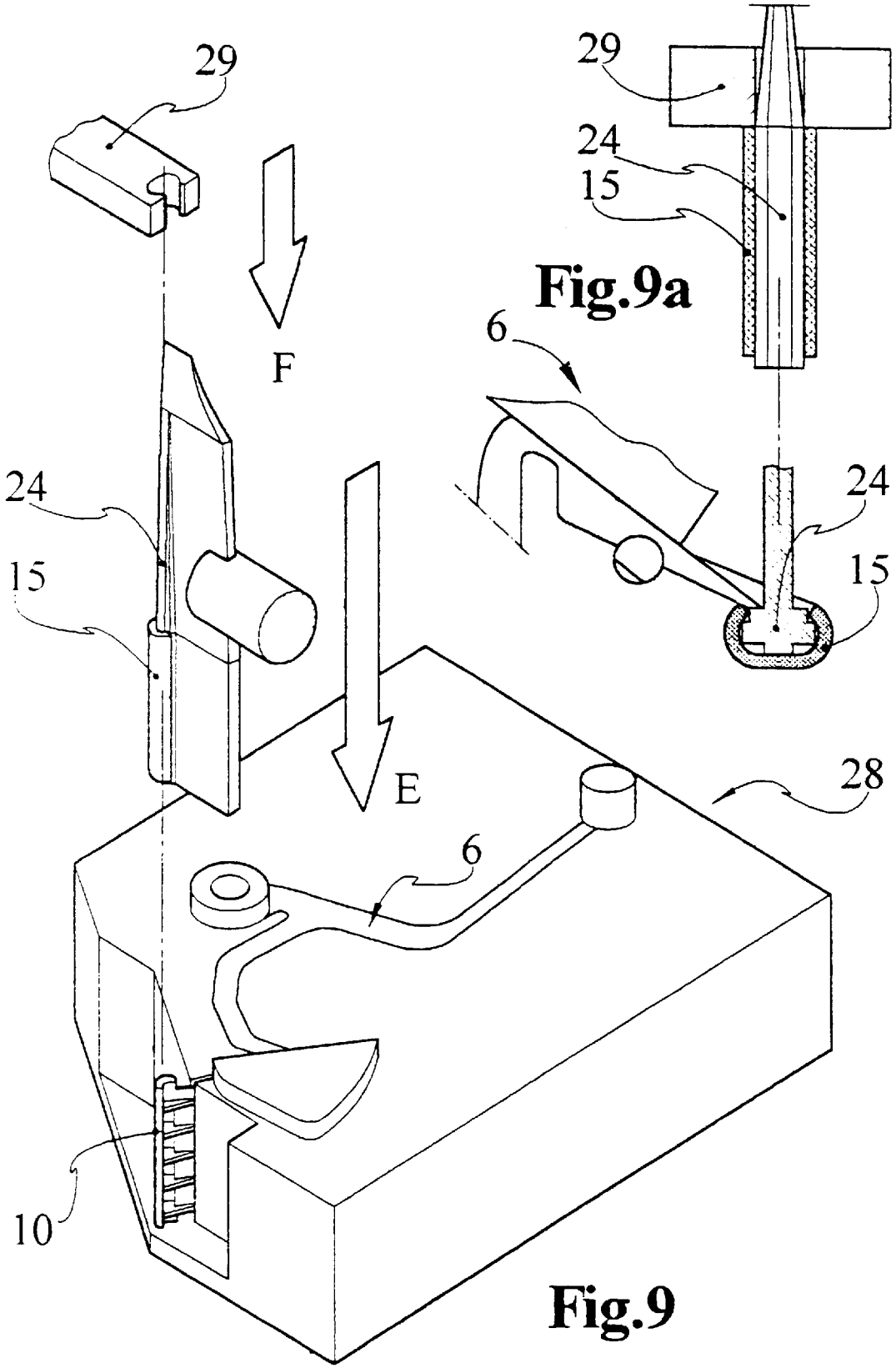

In the position reproduced in FIG. 9, the retaining mandrel 24 pivoted in the arrow direction D is in alignment and the clip-type slide element 15 is fed to the end piece 10 of the extension arm 9 of the applicator foot 6 positioned in a holding device 28.

After lowering of the retaining mandrel 24 in the arrow direction E, the clip-type slide element 15 can now be pushed in accurately fitting manner onto the end piece 10 by means of a stripper 29 moved in the arrow direction F (see the more exact illustration in FIG. 9*a*). Not illustrated is the pivoting of the extension arm 9 into the end position of the finished part, as shown in FIG. 4.

The invention is obviously not restricted to the illustrated embodiments. Further refinements are possible without departing from the basic concept. Thus, in particular, the device shown in FIG. 7 et seq can also be realised in other ways and suchlike.

What is claimed is:

1. An arrangement for forming a dispensing device for transferring a film from a carrier strip onto a substrate wherein the device includes an applicator foot having an end piece, said arrangement comprising a structure for forming a clip-on slide element from a tube section, said structure including a gripping holding device for holding the tube section, a conical retaining mandrel movably mounted for insertion into the tube section, a cutting device for slitting the tube section, a holder having mounting structure for holding the applicator foot and the end piece of the dispensing device, and said mounting structure which holds the end piece being in line with the path of movement of said mandrel whereby the cut tube section is transferred from said mandrel to the end piece of the dispensing device so that the cut tube section becomes the clip-on slide element of the applicator foot.

2. The arrangement of claim 1 wherein said gripping holding device includes an annular step for being contacted by the tube section.

3. The arrangement of claim 2 wherein said gripping holding device includes guide chamfers.

4. The arrangement of claim 3 wherein said cutting device is a front-mounted knife movable downwardly within said gripping holding device.

5. The arrangement of claim 1 wherein said gripping holding device includes guide chamfers.

6. The arrangement of claim 1 wherein said cutting device is a front-mounted knife movable downwardly within said gripping holding device.

7. The arrangement of claim 1 including a stripper movably mounted toward said mandrel for pushing said tube section off said mandrel and onto the end piece.

8. The arrangement of claim 1 combination with the dispensing device, said dispensing device including a housing having a supply reel and an empty reel with the carrier strip guided over said applicator foot, said applicator foot being in the form of a pivotally hinged extension arm having a receiving profile member for said slide element, and said slide element being made of a friction-reducing material.

* * * * *